US011259597B2

(12) United States Patent
Schumann

(10) Patent No.: US 11,259,597 B2
(45) Date of Patent: Mar. 1, 2022

(54) SHOE SOLE

(71) Applicant: Ronald Frederick Schumann, Forster (AU)

(72) Inventor: Ronald Frederick Schumann, Forster (AU)

( * ) Notice: Subject to any disclaimer, the term of this patent is extended or adjusted under 35 U.S.C. 154(b) by 9 days.

(21) Appl. No.: 15/755,622

(22) PCT Filed: Aug. 31, 2016

(86) PCT No.: PCT/AU2016/050816
§ 371 (c)(1),
(2) Date: Feb. 27, 2018

(87) PCT Pub. No.: WO2017/035586
PCT Pub. Date: Mar. 9, 2017

(65) Prior Publication Data

US 2018/0249785 A1 Sep. 6, 2018

(30) Foreign Application Priority Data

Aug. 31, 2015 (AU) ..... 2015903544

(51) Int. Cl.

| | |
|---|---|
| ***A43B 13/22*** | (2006.01) |
| ***A43B 5/02*** | (2006.01) |
| ***A43B 13/26*** | (2006.01) |
| ***A43C 15/16*** | (2006.01) |

(52) U.S. Cl.
CPC ..... *A43B 13/223* (2013.01); *A43B 5/02* (2013.01); *A43B 13/26* (2013.01); *A43C 15/162* (2013.01); *A43C 15/164* (2013.01); *A43C 15/167* (2013.01)

(58) Field of Classification Search
CPC ..... A43B 13/223; A43B 13/226; A43B 13/22; A43B 13/26; A43B 5/02; A43C 15/167; A43C 15/164; A43C 15/162
See application file for complete search history.

(56) References Cited

U.S. PATENT DOCUMENTS

| | | | | |
|---|---|---|---|---|
| 2,433,303 | A * | 12/1947 | Spini | A43B 13/223 36/59 C |
| 3,822,488 | A * | 7/1974 | Johnson | A43B 5/06 36/129 |
| 4,184,272 | A | 1/1980 | Riggs | |
| 4,212,120 | A | 7/1980 | Bowerman et al. | |
| 4,309,831 | A * | 1/1982 | Pritt | A43B 7/06 36/3 B |
| 4,327,503 | A * | 5/1982 | Johnson | A43B 13/223 36/129 |

(Continued)

FOREIGN PATENT DOCUMENTS

| | | | |
|---|---|---|---|
| AU | 1978038028 | A1 | 1/1980 |
| CA | 2183880 | A1 | 8/1997 |

(Continued)

*Primary Examiner* — Shaun R Hurley
*Assistant Examiner* — Bao-Thieu L Nguyen
(74) *Attorney, Agent, or Firm* — WC&F IP

(57) ABSTRACT

A shoe sole (100) comprising a bottom surface, the bottom surface having a front array (110) of ground engaging formations having a first height or depth, and a rear array (120) of ground engaging formations having a second height or depth, the rear array of ground engaging formations generally located at a heel portion of the sole, wherein the first height or depth is greater than the second height or depth.

10 Claims, 4 Drawing Sheets

(56) References Cited

U.S. PATENT DOCUMENTS 4,378,643 A * 4/1983 Johnson ..... A43B 13/223 36/129
4,392,312 A * 7/1983 Crowley ..... A43B 13/26 36/126
4,484,398 A * 11/1984 Goodwin ..... A43B 5/185 36/127
4,546,559 A * 10/1985 Dassler ..... A43B 5/06 36/114
4,559,724 A * 12/1985 Norton ..... A43B 5/06 36/114
4,569,142 A * 2/1986 Askinasi ..... A43B 13/26 36/134
4,885,851 A * 12/1989 Peterson ..... A43B 3/0094 36/127
5,384,973 A * 1/1995 Lyden ..... A43B 13/12 36/102
6,029,377 A * 2/2000 Niikura ..... A43B 13/223 36/59 C
6,035,559 A 3/2000 Freed et al.
6,101,746 A 8/2000 Evans
6,145,221 A 11/2000 Hockerson
8,250,781 B2 * 8/2012 Gerber ..... A43C 15/161 36/100
8,286,371 B2 * 10/2012 Baker ..... A43C 15/168 36/128
8,776,403 B2 * 7/2014 Eder ..... A43B 13/26 36/114
9,021,722 B2 * 5/2015 Kasprzak ..... A43B 13/223 36/127
9,402,442 B2 * 8/2016 Rapf ..... A43B 13/141
2001/0011428 A1 * 8/2001 Gelsomini ..... A43B 3/0094 36/127
2004/0074111 A1 4/2004 Oorei
2004/0148806 A1 8/2004 Sussmann
2007/0175064 A1 * 8/2007 Culton ..... A43B 1/0081 36/7.1 R
2008/0072462 A1 * 3/2008 Fusco ..... A43B 5/00 36/25 R
2009/0293315 A1 * 12/2009 Auger ..... A43B 5/02 36/114
2011/0047834 A1 * 3/2011 Baker ..... A43B 13/223 36/67 A
2011/0126428 A1 * 6/2011 Hazenberg ..... A43B 13/18 36/103
2011/0252669 A1 * 10/2011 Kasprzak ..... A43B 5/001 36/127
2012/0210608 A1 * 8/2012 Baker ..... A43C 15/14 36/134
2013/0036632 A1 * 2/2013 Malarkar ..... A43B 5/001 36/134
2013/0047465 A1 * 2/2013 Auger ..... A43B 13/223 36/66
2013/0255102 A1 10/2013 Terrell
2014/0026438 A1 * 1/2014 Cortez ..... A43B 13/181 36/28
2014/0026441 A1 * 1/2014 Stauffer ..... A43B 13/141 36/103
2014/0202042 A1 * 7/2014 Berend ..... A43B 13/141 36/25 R
2014/0230283 A1 * 8/2014 Cordova ..... A43B 3/246 36/103
2015/0089842 A1 * 4/2015 Zamer-Juarez ..... A43B 5/06 36/103
2015/0181977 A1 * 7/2015 Klug ..... A43B 13/26 36/134
2016/0120265 A1 * 5/2016 Cavaliere ..... A43C 15/161 36/134
2017/0238656 A1 * 8/2017 Hurd ..... A43B 13/223
2018/0153264 A1 * 6/2018 Amos ..... A43B 1/0009
2018/0206590 A1 * 7/2018 Amos ..... A43B 1/0009
2018/0263341 A1 * 9/2018 Caldwell ..... A43B 5/02
2018/0343979 A1 * 12/2018 Yoshida ..... A43B 23/22
2018/0352902 A1 * 12/2018 Wardle ..... A43B 5/02
2019/0037970 A1 * 2/2019 Klug ..... A43B 13/122

FOREIGN PATENT DOCUMENTS

EP 0025020 A2 3/1981
WO 9713422 A1 4/1997

* cited by examiner

A = 15mm to 20mm

B = 8mm to 10mm

C = 10mm to 12mm

SHOE SOLE

FIELD OF THE INVENTION

The present invention relates to sports shoes. More particularly, it relates to the soles for sports shoes which help minimise injuries arising from twisting and turning movements during a sporting activity, particularly those which may occur during a collision with other players, whether in a contact or non-contact sport.

BACKGROUND OF THE INVENTION

Sports shoes or boots are designed and manufactured according to the requirements and movements associated with the particular sport. For example, during game play, a rugby, soccer or football player needs to frequently stop and run on the field, and often needs to change directions. Appropriate footwear for soccer or football play thus needs to allow ground grip or traction for the safety of the player, and also enable mobility in different directions. A football or soccer player can also experience collisions or tackles during the course of play. The force from the collisions or tackles may produce twisting or turning movements, potentially resulting in injuries to the person being tackled.

Any reference herein to known prior art does not, unless the contrary indication appears, constitute an admission that such prior art is commonly known by those skilled in the art to which the invention relates, at the priority date of this application.

SUMMARY OF THE INVENTION

The present invention provides a shoe sole, comprising a bottom surface, the bottom surface having a front array of ground engaging formations having a first height or depth, and a rear array of ground engaging formations having a second height or depth, the rear array of ground engaging formations generally located at a heel portion of the sole, wherein the first height or depth is greater than the second height or depth.

The rear array of ground engaging formations can be protrusions.

The rear array of ground engaging formations can be elongated protrusions, or protrusions which are aligned in a plurality of linear or curved lines.

The elongated protrusions can be approximately 10 to 20 millimetres in length.

The elongated protrusions can be between approximately 2 to 4 millimetres in width as measured transverse to a longitudinal axis of the elongated protrusions.

The rear array of ground engaging formations can be oriented non-parallel to a longitudinal axis of the sole.

The rear array of ground engaging formations can be transverse to the longitudinal axis of the sole.

The rear array of ground engaging formations can be parallel ribs which extend from a lateral side to a medial side of the sole.

The parallel ribs can be approximately 10 millimetres apart.

The rear array of ground engaging formations can be angled from the longitudinal axis of the sole.

The rear array of ground engaging formations can be spaced apart chevrons, boomerang shapes, or crescents.

Apexes of the chevrons or convex centres of the crescents can point toward a rear of the sole.

The rear array of ground engaging formations can be one or a combination of more than one of the following: elongated ribs, conical studs, frusto-conical studs, cylindrical studs, semi-spherical studs.

The height or depth of the rear array of ground engaging formations can be between approximately 2 to 5 millimetres.

The rear array of ground engaging formations can extend perpendicularly from the bottom surface.

The rear array of ground engaging formations can extend obliquely from the bottom surface.

The present invention also provides a heel portion for a shoe sole, adapted to be assembled to a shoe having a front sole portion, the heel portion of the shoe sole carrying a rear array of ground engaging formations, the rear array of ground engaging formations having a height or depth that is less than a height or depth of front ground engaging formations of said front sole portion.

The rear array of ground engaging formations can be integral with the heel portion.

The rear array of ground engaging formations can be detachable.

The rear array of ground engaging formations can be located on detachable plate.

The present invention also provides a shoe sole comprising a heel portion mentioned above.

The present invention further provides a shoe comprising a sole as mentioned in the paragraphs above.

BRIEF DESCRIPTION OF THE DRAWINGS

An embodiment or embodiments of the present invention will now be described, by way of example only, with reference to the accompanying drawings, in which.

DETAILED DESCRIPTION OF THE EMBODIMENT OR EMBODIMENTS

For the purpose of this specification, directional references "front", "back", "left" and "right" are made with respect to the wearer.

Figure 1:
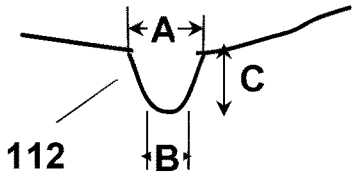
FIG. 1 is an underneath view of a shoe sole.

FIG. 1 depicts a shoe sole 100 which is suitable for a sports boot. It is in particular suitable for sporting activities where the wearer experiences impacts from collisions or tackles, or needs to have the mobility to stop, run, and change directions. The shoe sole 100 provides a quantum of traction in the front region of the shoe which is different or greater than then quantum of traction in the rear region. The outsole 105, being the bottom surface of the shoe sole 100, has a front array of ground engaging formations 110, and a rear array of ground engaging formations 120. The formations are protrusions or extend downwardly from the outsole 105. They can be generally described as ribs, cleats, or studs, or combinations thereof.

During a sporting activity, a player can be tackled or a body collision can occur. However, due to the ground penetration of the ground engaging members, the wearer's shoe often remains engaged with the ground during the initial impact, rather than moving in response to the impact. As a result, during the initial impact the wearer's heel remains unmoved with respect to the toes, while his or her leg turns or moves sideways from the force of the impact. The twisting or turning which potentially results at the ankle of the player can lead to injuries. The different traction provided by the front and rear arrays of the ground engaging formations 110, 120 respectively assist to minimise the likelihood of injuries of this kind.

Figure 2:
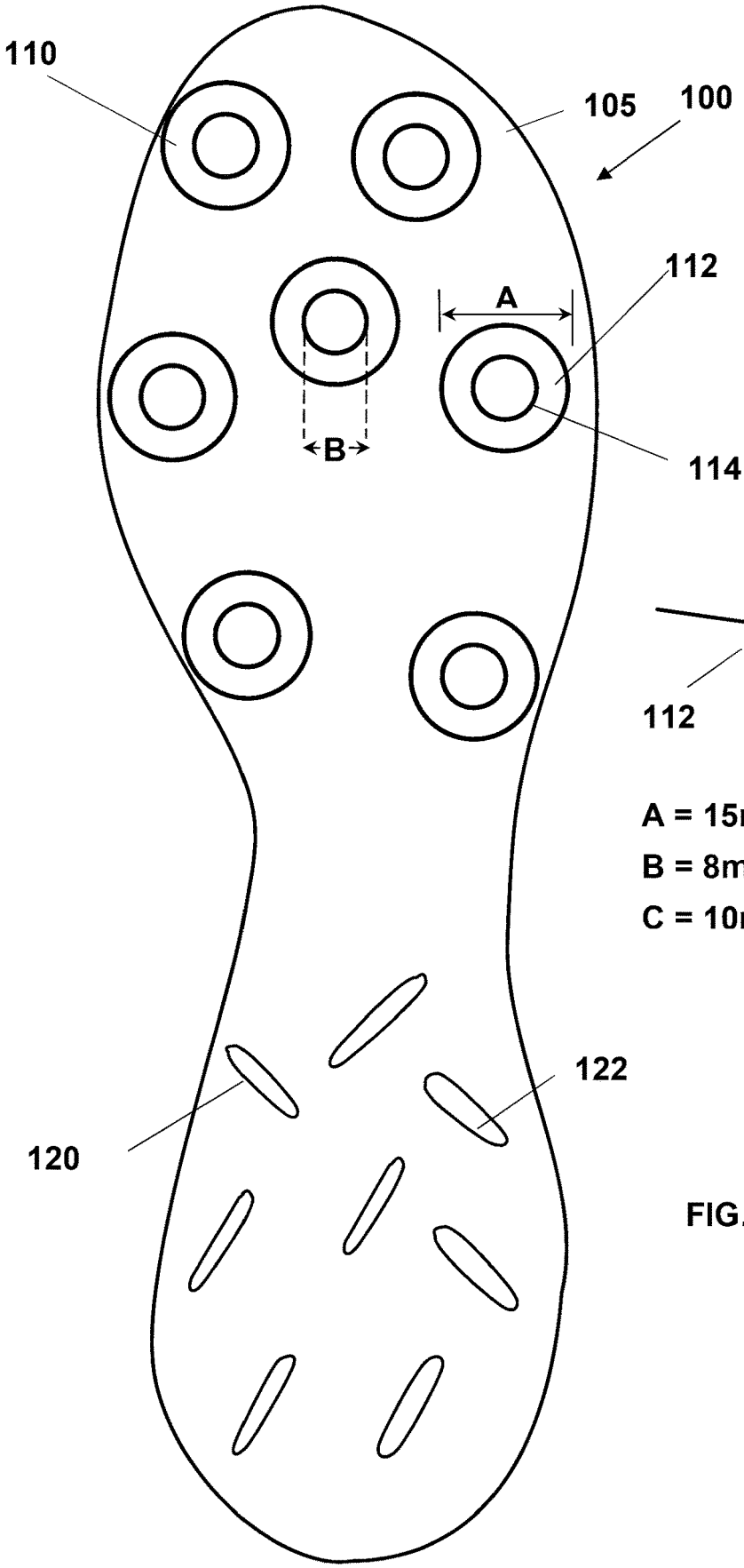
FIG. 2 is an elevational view of a front ground engaging formation.

In the embodiment shown, the front array of ground engaging formations 110 includes a plurality of, for example seven, bulges or studs 112 which provide traction with respect to the ground. The front array of ground engaging formations 110 are suited for providing traction and reducing slippage, especially during forefoot striking, which frequently occurs when the wearer runs, jumps, or lands from a jump. As shown in FIG. 2, the studs 112 are generally shaped like rounded, truncated cones, as is common in the art of football shoes. Projecting from the outsole 105, the stud 112 has a base 114 with a larger diameter "A". From the base 114 the stud 112 decreases in diameter and ends in a crown 116 having a smaller diameter "B". The studs 112 have a first distance or height or depth "C" between the base 114 and the crown 116. That is, in use the studs 112 reach a height or depth "C" from the outsole 105. The crown 116 is rounded in the depicted embodiment, but need not be.

In one example, each stud 112 has a base diameter "A" of about 15 to 20 millimetres (mm), a crown or tip with a diameter "B" of about 8 to 10 mm, and a height or depth "C" of about 10 to 12 mm. Other dimensions may be used to account for factors such as the age, shoe size and gender of the intended wearer.

The shoe sole 100 further includes a rear array of ground engaging formations 120. The rear array 120 of formations are generally located at a heel portion of the sole 100. They provide traction during heel striking which may occur during running, jumping, or landing, and further enhances stability by reducing slippage. The rear array of ground engaging formations 120 therefore also penetrates into the ground. Thus the formations 120 downwardly extend or project from the bottom surface 105 by a distance, height or depth "D". That is, the rear array of ground engaging formations, in use, has a depth "D" from the outsole 105.

To enable the wearer's heel to turn with his or her leg, to reduce the likelihood of twisting injuries, the height or depth "D" of the rear array of ground engaging formations 120 is less than the height or depth "C" of the front array of ground engaging formations 110. Therefore, the front array of ground engaging formations 110 are able to penetrate deeper into the ground than the rear array of ground engaging formation 120. The difference between the height or depth "C" of the front studs 112 and the height or depth "D" of the rear array 120 can be seen in FIG. 3. Instead of traditionally shaped studs, the rear array of ground engaging formations 120 include traction pads 122, which provide traction but do not penetrate into the ground to the same extent as the front studs 112. Due to the difference in height, depth or length of penetration, the heel portion will move laterally relative to the front portion with much less force than would be applied to the front portion of the foot to effect the same lateral movement.

Figure 3:
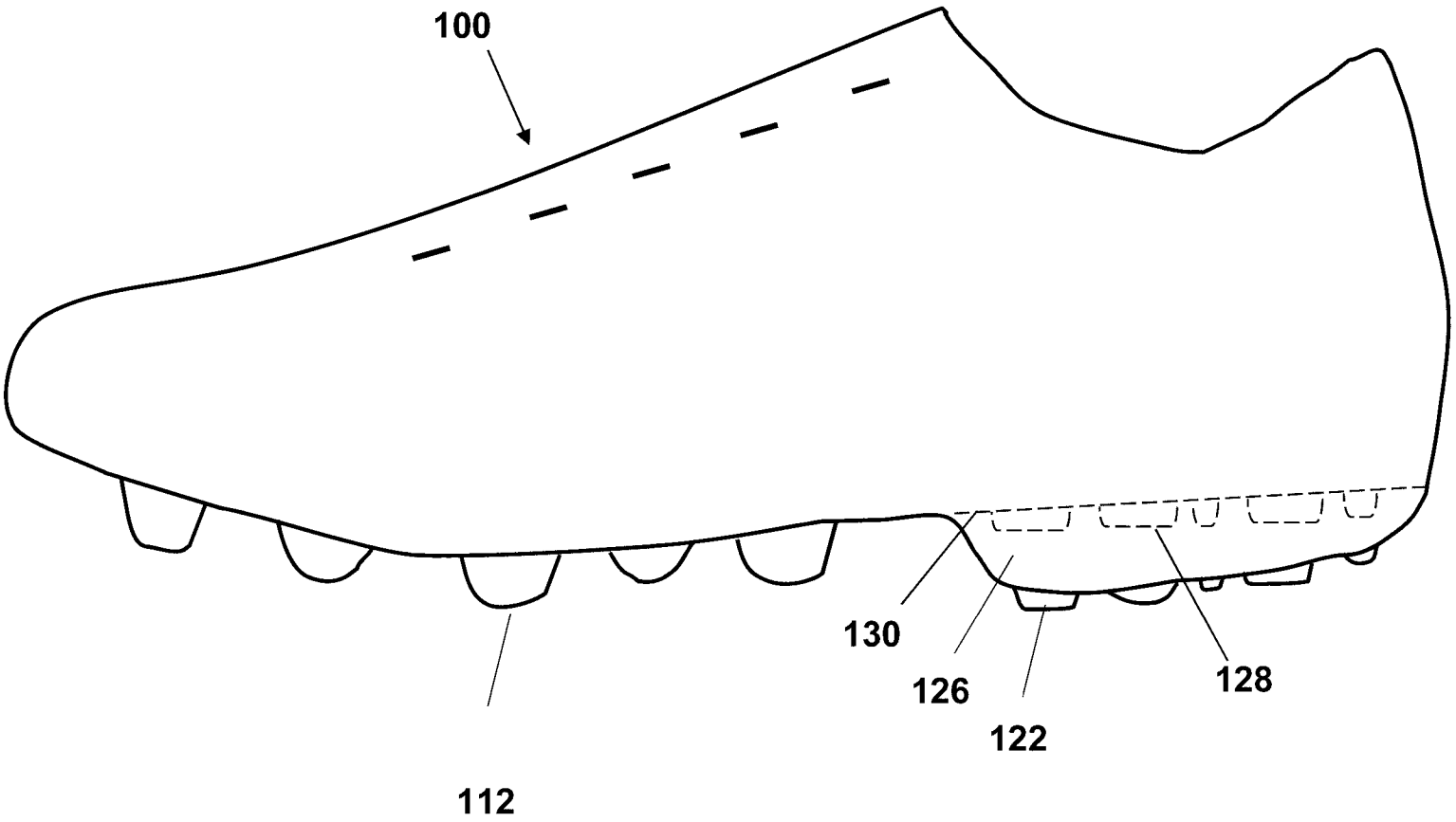
FIG. 3 is an elevational view of a shoe having the shoe sole of FIG. 1.

In the embodiment shown in FIG. 3, the shoe 100 has a raised heel 126 (i.e. the sole 105 includes a raised heel 126). The rear ground engaging formations 122 extend below the raised heel 126. However ground engaging formations can also be applied to shoes with no raised heels, as represented in dashed lines, where the rear formations 128 extend below a flat heel 130.

Figure 4:
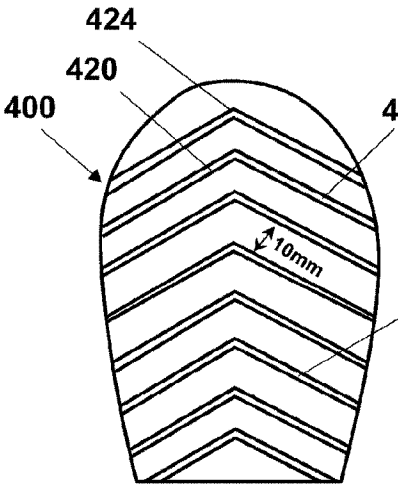
FIG. 4 is an underneath view of a rear array of ground engaging formations.
Figure 5:
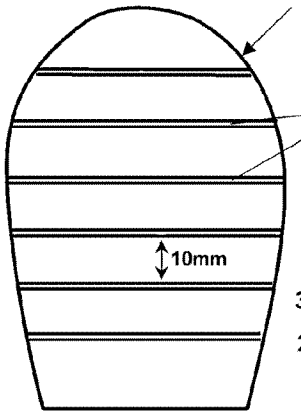
FIG. 5 is an underneath view of a rear array of ground engaging formations according to another embodiment.
Figure 6:
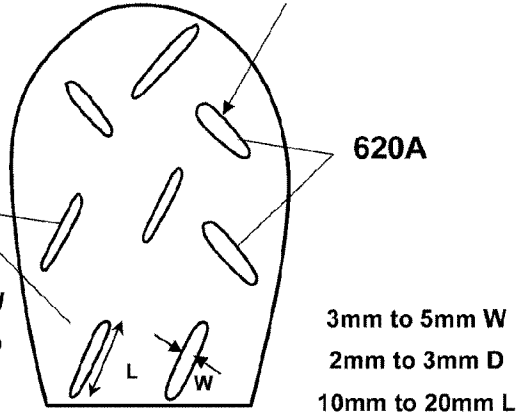
FIG. 6 is a plan view of a rear array of ground engaging formations according to another embodiment.

Referring to FIGS. 4 to 6, the rear array of ground engaging formations 120 are oriented to facilitate a sideways movement, or reduce the force required to effect a lateral movement of the shoe heel, and thereby the wearer's heel. The orientations of the rear formations are selected to as to facilitate lateral movement of the shoe heel upon the application of an external lateral force. In the embodiment shown in FIGS. 1, 4, and 6, the rear array of ground engaging formations 120 are elongated ribs, with a direction of elongation being at an angle to the longitudinal axis "Y" of the sole 100. In the embodiment shown in FIG. 5, the rear array of ground engaging formations 120 are transverse, or at a right angle, to the longitudinal axis "Y". In either case, the rear array of ground engaging formations 120 are non-parallel to the axis "Y".

Figure 7:
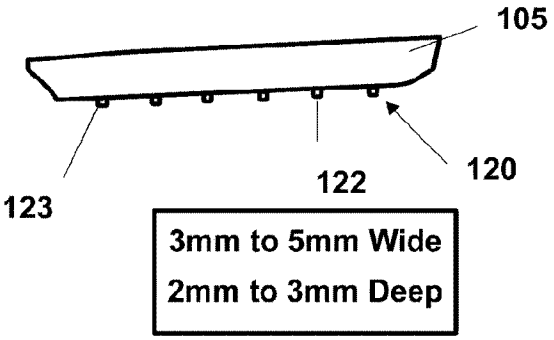
FIG. 7 is a side view of the sole shown in FIG. 4.
Figure 8:
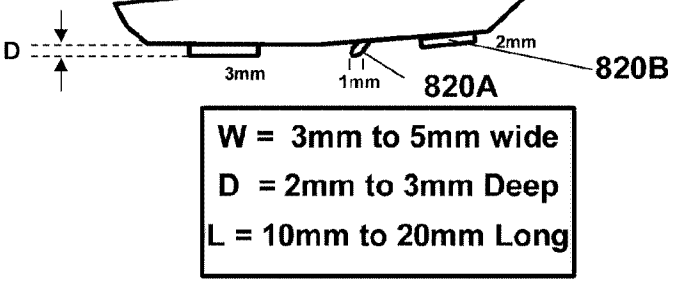
FIG. 8 is a side view of the sole shown in FIG. 5.

As shown in FIG. 7, the rear array of ground engaging formations 120 have a rounded profile. Each rib or traction pad 122 extends perpendicularly rom the outsole 105 and ends in a rounded tip 123. As shown in FIG. 8, the rear formations 820 alternatively extend obliquely from the outsole 105. The oblique angle of formations 820B can be seen in FIG. 8. In further embodiments, the rear formations 120 include some formations which extend obliquely and some which extend perpendicularly from the outsole 105. The oblique angle is chosen in accordance with the requirements of the particular sport, and the physiology of the intended wearer.

In the embodiment shown in FIG. 4, the rear array of ground engaging formations 400 include a series of spaced part, parallel elongated ribs 420. Each rib 420 takes the shape, or have an outline, of a chevron or an inverted "V", extending between the lateral side of the shoe sole and the medial side, and having its apex 424 along the midline "Y". Divided by the midline represented by "Y", the lateral half and medial half of the ground engaging ribs 420 facilitate movements in their respective orientations.

Figure 9:
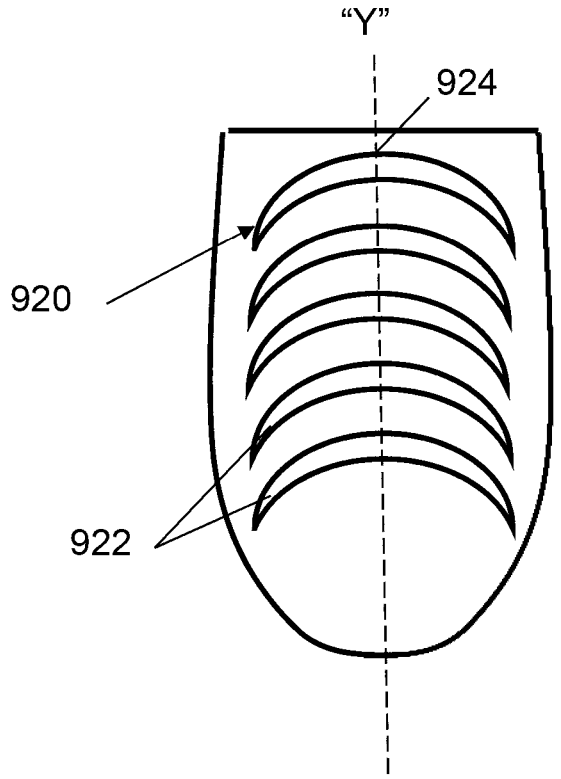
FIG. 9 is an underneath view of a rear array of crescent shaped ground engaging formations.
Figure 10:
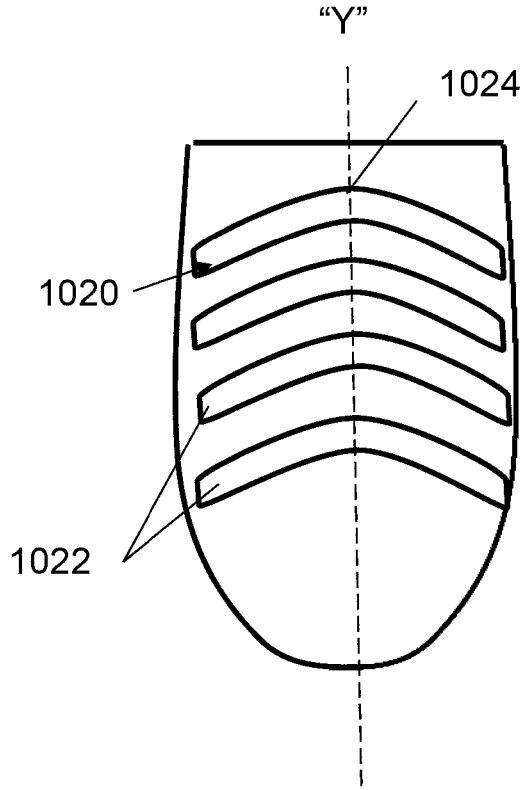
FIG. 10 is an underneath view of a rear array of boomerang shaped ground engaging formations.

Other types of ground engaging formations can be used instead of an inverted V or a chevron. FIG. 9 depicts a rear array of ground engaging formations 920, which include crescent shaped ribs or pads 922, with convex centres 924 located on the midline "Y" of the shoe sole. FIG. 10 depicts a similar rear ground engaging array 1020, but with boomerang shaped formations. The apexes or convex centres 924, 1024 of the ground engaging formations 922, 1022 are shown as pointing toward the front (i.e. toe region) of the shoe sole, but in other embodiments they point toward the rear (i.e. heel region) of the shoe sole. For example the rear ground engaging formations shown in FIG. 4 have central apexes 424 that point toward the rear.

In the embodiment shown in FIG. 5, the rear array of ground engaging formations include a series of parallel ribs 520 which are generally straight and extend between the lateral and medial sides of the shoe sole 500.

In the embodiments shown in FIGS. 4 and 5, each ground engaging formation 420, 520 extend from side-to-side.

However the formations need not reach the medial and lateral edges of the shoe sole 400, 500.

As examples only, the ribs shown in FIGS. 4 and 5 are spaced apart by about 10 mm. Each rib has a height or depth "D" of about 2 to 3 mm, and a width "W", as measured transverse to the longitudinal axis of the rib, of about 3 to 5 mm. These dimensions may be varied according to factors such as the age, shoe size and gender of the wearer.

In the embodiment shown in FIG. 6, which is similar to that shown in FIG. 1, the rear ground engaging formations 620 include a plurality of protrusions 620A which are directed in a first orientation, and another plurality of protrusions 620B which are directed in a second orientation. In this example, each protrusion is about 3 to 5 mm in width "W", 10 to 20 mm in length "L", and 2 to 3 mm in height (downward length) or depth "D".

Figure 11:
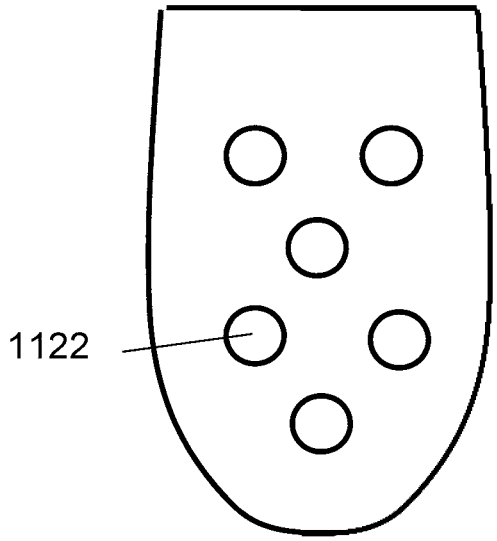
FIG. 11 is an underneath view of a rear array of ground engaging formations comprising studs.
Figure 12:
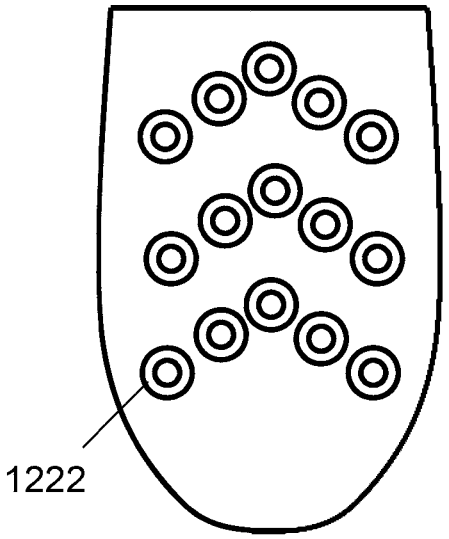
FIG. 12 is an underneath view of a rear array of ground engaging formations comprising aligned studs.

The examples of the rear ground engaging formations provided above are not intended to be exhaustive of all formations which embody the spirit of the invention discussed herein. While the rear formations shown in FIGS. 1, 4, 5, and 6 are elongated, they may have other shapes. For example, as shown in FIG. 11, the rear formations 1122 can be cylindrical, hemispherical, spherical, frusto-conical, or conical protrusions or studs. In further embodiments, each single protrusion, instead of being unitary, can comprise a series of aligned studs or protrusions. Each line of aligned studs or protrusions is orientation that is transverse or oblique to the centreline "Y" of the shoe sole. For example FIG. 12 shows rear formations comprising discrete studs or protrusions 1222 which are aligned in inverted "V" shapes.

To manufacture the shoe sole, the front array of ground engaging formations 110 are formed, e.g. moulded, integrally or unitarily with the shoe sole. Alternatively they are formed separately and then attached to the shoe sole, for example by screwing. The rear array of ground engaging formations 120 can also integral or unitary with the sole, or alternatively detachable from and separate to the sole. In further embodiments, the rear formations 120 are integrally provided on or attached to a separate layer, such as a plate, that is attachable to the shoe sole. The rear formations, carried on the plate, are replaceable when they are worn out, by detaching the plate from the shoe sole. In some embodiments the detachable plate or layer is intended for assembly onto the heel portion of the shoe sole.

Where ever it is used, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

It will be understood that the invention disclosed and defined herein extends to all alternative combinations of two or more of the individual features mentioned or evident from the text. All of these different combinations constitute various alternative aspects of the invention.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, and all modifications which would be obvious to those skilled in the art are therefore intended to be embraced therein.

The invention claimed is:

1. A shoe sole for a contact sport shoe, the shoe sole comprising:

a bottom surface having a front region and a heel region with a central longitudinal axis extending in a direction from the heel region to the front region;

a plurality of front ground penetrating formations arranged in the front region configured to engage with and penetrate the ground during a sporting activity, the plurality of front ground penetrating formations in the front region comprising a plurality of studs projecting from the bottom surface; and a plurality of rear ground penetrating formations arranged in the heel region configured to engage with and penetrate the ground during a sporting activity, the plurality of rear ground penetrating formations in the heel region comprising elongated ribs projecting from the bottom surface, wherein the elongated ribs are the only rear ground penetrating formations extending from the bottom surface, and wherein each elongated rib has a direction of elongation which is non-parallel to the longitudinal axis and/or each elongated rib extends laterally with respect to the longitudinal axis, wherein the studs in the front region have a first height or depth from the bottom surface and the ribs in the heel region have a second height or depth from the bottom surface which is less than the first height or depth.

2. A shoe sole according to claim 1, wherein the elongated ribs are V shaped having two legs meeting at an apex, the V shaped ribs extending from one side of the sole to the other, and being spaced apart from one another in the direction of the longitudinal axis with each leg extending laterally with respect to the longitudinal axis.

3. A shoe sole according to claim 2, wherein the elongated ribs are arranged in spaced apart relation, one behind the other, the apex of each elongated rib extending forwardly with respect to the legs, towards the front region, the apexes aligned along the longitudinal axis.

4. A shoe sole according to claim 1, wherein the elongated ribs are arranged in spaced apart parallel relation one behind the other and extend from one side of the sole to the other at about right angles to the longitudinal axis.

5. A shoe sole according to claim 1, wherein the elongated ribs are boomerang shaped or crescent shaped and are arranged in spaced apart relation one behind the other.

6. A shoe sole according to claim 1, wherein there is a first group of said elongated ribs having their elongation direction in a first orientation which is lateral with respect to the longitudinal axis and a second group of said elongated ribs having their elongation direction in a second orientation which is lateral with respect to the longitudinal axis.

7. A shoe sole according to any one of claim 1, wherein the studs have a base and a crown or tip spaced from the base, the base having a base diameter and the crown or tip having a crown diameter, the base diameter being greater than the crown diameter.

8. A shoe sole according to claim 1, wherein the studs are in the shape of a truncated cone.

9. A shoe comprising a shoe sole according to claim 1.

10. A shoe sole according to claim 1, wherein the elongated ribs in the heel region are oriented to facilitate lateral movement of the heel region when engaged with and penetrating the ground.

* * * * *